US005301392A

United States Patent [19]

Richman

[11] Patent Number: 5,301,392

[45] Date of Patent: Apr. 12, 1994

[54] MULTI-PURPOSE BALLOON CLOSURE DEVICE

[76] Inventor: Marvin J. Richman, 3238 Fond Dr., Encino, Calif. 91436

[21] Appl. No.: 896,622

[22] Filed: Jun. 10, 1992

[51] Int. Cl.[5] ..... B65D 77/10

[52] U.S. Cl. ..... 24/30.5 R; 24/559

[58] Field of Search ..... 248/205.3, 689; 446/222; 224/217; 251/10; 24/30.5 R, 543, 487, 559

[56] References Cited

U.S. PATENT DOCUMENTS

| | | | |
|---|---|---|---|
| 338,218 | 3/1886 | Butler | 24/559 X |
| 1,201,045 | 10/1916 | Head | 251/10 X |
| 2,072,851 | 3/1937 | Bailey | 224/217 X |
| 3,818,553 | 6/1974 | Parmenter | 24/30.5 R |
| 4,897,900 | 2/1990 | Baggett | 24/543 |
| 4,936,532 | 6/1990 | Williams | 446/222 X |
| 5,056,197 | 10/1991 | Cohen | 24/543 X |

FOREIGN PATENT DOCUMENTS

| | | | |
|---|---|---|---|
| 614520 | 12/1960 | Italy | 24/487 |

*Primary Examiner*—James R. Brittain

*Attorney, Agent, or Firm*—Koda and Androlia

[57] ABSTRACT

A multi-purpose closure device for the tubular stem of an inflatable balloon including two wings which are interconnected by a hinge for movement from an open to an interlocked position wherein a stem of an inflated balloon is held therebetween and a closure member mounted on one wing passes through an opening on the other and interlocks with the other wing in order to seal the stem of the inflated balloon whereby a balloon can be reliably sealed by compressing and clamping a balloon stem. The closure member may also be provided with an adhesive layer on at least one wing for attachment to other surfaces, an opening in the hinge for a string and tapered portions adjacent the hinge to hold a string.

7 Claims, 6 Drawing Sheets

MULTI-PURPOSE BALLOON CLOSURE DEVICE

BACKGROUND OF THE INVENTION

1. Field of the Invention

The present invention relates to balloon closure devices and particularly to multi-purpose balloon closure devices for sealing, capturing, attaching and making decorative arrangements from balloons.

2. Prior Art

The prior art has recognized that the stems of inflated balloons are difficult to manipulate in order to tie them into knots or to tie string or some other line around them to seal them in order to prevent the leakage of lighter than air gas or air. As a result, there may be significant leakage of gas during the process of tying and thereafter. Conversely, the more effectively the knot is tied to prevent leakage, the less likelihood there is that the knot can be reopened, relegating the balloon to one time use, and making the balloon difficult to dispose of since it can only be deflated by bursting it or by allowing the gas to gradually seep out.

To overcome these difficulties, there have been developed balloon closure devices, clips and clamps, but such devices are unreliable and examples of such devices are disclosed in U.S. Pat. Nos. 1,201,045; 3,094,807; 4,416,038; 3,612,465; 3,713,622; and 4,390,103.

In addition to the difficulties described above, the adherence of an inflated balloon to surfaces presents a particular problem. In the case of balloons which are inflated with a lighter than air gas, traditionally tape or some other adhesive means has been provided directly on the balloon and used to fasten it to walls, ceilings, streamers and other surfaces for decorative purposes. Balloons inflated with lighter than air gases have been similarly fastened to surfaces for decorative purposes, or allowed to float to ceilings, or tied by string or other capturing devices to furniture or other stationary objects.

Still further, the attachment of balloons to hold them captive for decorative purposes or for transport has been generally by means of string, line or some other retainer, attached on one end to a tubular stem of an inflated balloon and held by hand or attached in some makeshift manner to furniture or some other surface or object of the room. This solution has presented somewhat of a problem because it has required the tying of a knot on the stem of the inflated balloon which is time consuming and cumbersome. However, if the balloon is held captive by tying it to another surface, yet another time consuming and cumbersome tying operation is required. Furthermore, the line which holds the inflated balloon captive may be hand held and, as such, is hard to control and retain, especially by children.

Additionally, the placement of balloons in decorative or divergent arrangements of various sizes such as hand held bouquets, table place settings and room size configurations has heretofore represented additional problems. Traditionally, balloon users have sealed the stems of balloons by tying them by hand and, in turn, tying individual balloons together and then, further, tying these clusters onto a stationary object, arm of a person, string, line or other means to retain the balloons and form them into decorative shapes. Complex or large decorative devices have traditionally only been created and installed by balloon professionals because of the attendant problems associated therewith. In addition to the problems related to tying the balloons, the range of decorations has been limited by the ability to manipulate balloons. As a result, the ability to create large and/or complex decorations using balloons has been generally the realm of a professional and the balloon user who does not have access to lighter than air gas is particularly limited since most balloon related decorations utilize lighter than air gas to float the balloons which provides the levitation frequently to be used to help create one of these decorative designs. Therefore, the ability to fashion useful decorative designs utilizing non-floating balloons has heretofore been very limited, but would be of great value to the casual balloon user who may not have access to lighter than air gas and who would, otherwise, be deprived of the opportunities to create complex balloon-related decorations.

SUMMARY OF THE INVENTION

It is the general object of the present invention to provide a multi-purpose balloon closure and handling device which overcomes the difficulties and problems presented by the prior art discussed above and which better accomplishes each of its various purposes better than the single purpose devices of the prior art.

It is a particular object of the present invention to provide an easy to use closure devices which may be clamped on the tubular stem of a balloon to provide a leak proof seal, which may be removed without affecting the integrity of the balloon, to thereby allow the balloon to be deflated and stored for future use.

It is still another object of the present invention to provide a balloon closure device which can be mounted on virtually any surface without damage to the surface to which it is adhered.

It is yet another object of the present invention to provide a balloon closure device which is intended to retain the balloons and hold them captive so that they can be easily formed into decorative and divergent arrangements.

It is also still another object of the present invention to provide a simple to operate device for capturing, retaining and transporting one or more inflated balloons.

It is an additional object of the present invention to provide a balloon closure device which is very simple, inexpensive and which may be mass produced using simple tools and equipment.

It is also yet another object of the present invention to provide a balloon closure device which reliably seals the balloon stem to prevent leakage.

In keeping with the principles of the present invention, the objects are accomplished by a unique multipurpose balloon closure device for the tubular stem of an inflated balloon which includes two wings which are interconnected by a hinge for movement from an opened to an interlocked position wherein a stem of an inflated balloon is held therebetween and a closure member mounted on one wing passes through an opening on the other wing and interlocks with the other wing in order to seal the stem of the inflated balloon. In addition, an adhesive may be provided on one or more exterior surfaces of one or both wings so that the balloon closure device of the present invention can be adhered to other balloon closure devices, external surfaces and children. Still further, the present invention may be provided detachably in a multiple form so that a plurality of balloons may be sealed and held for transport and to make decorative designs.

BRIEF DESCRIPTION OF THE DRAWINGS

The above-mentioned features and objects of the present invention will become more apparent with reference to the following description taken in accompaniment with the attached drawings in which like reference elements denotes like elements and in which.

DETAILED DESCRIPTION OF THE INVENTION

Figure 1:
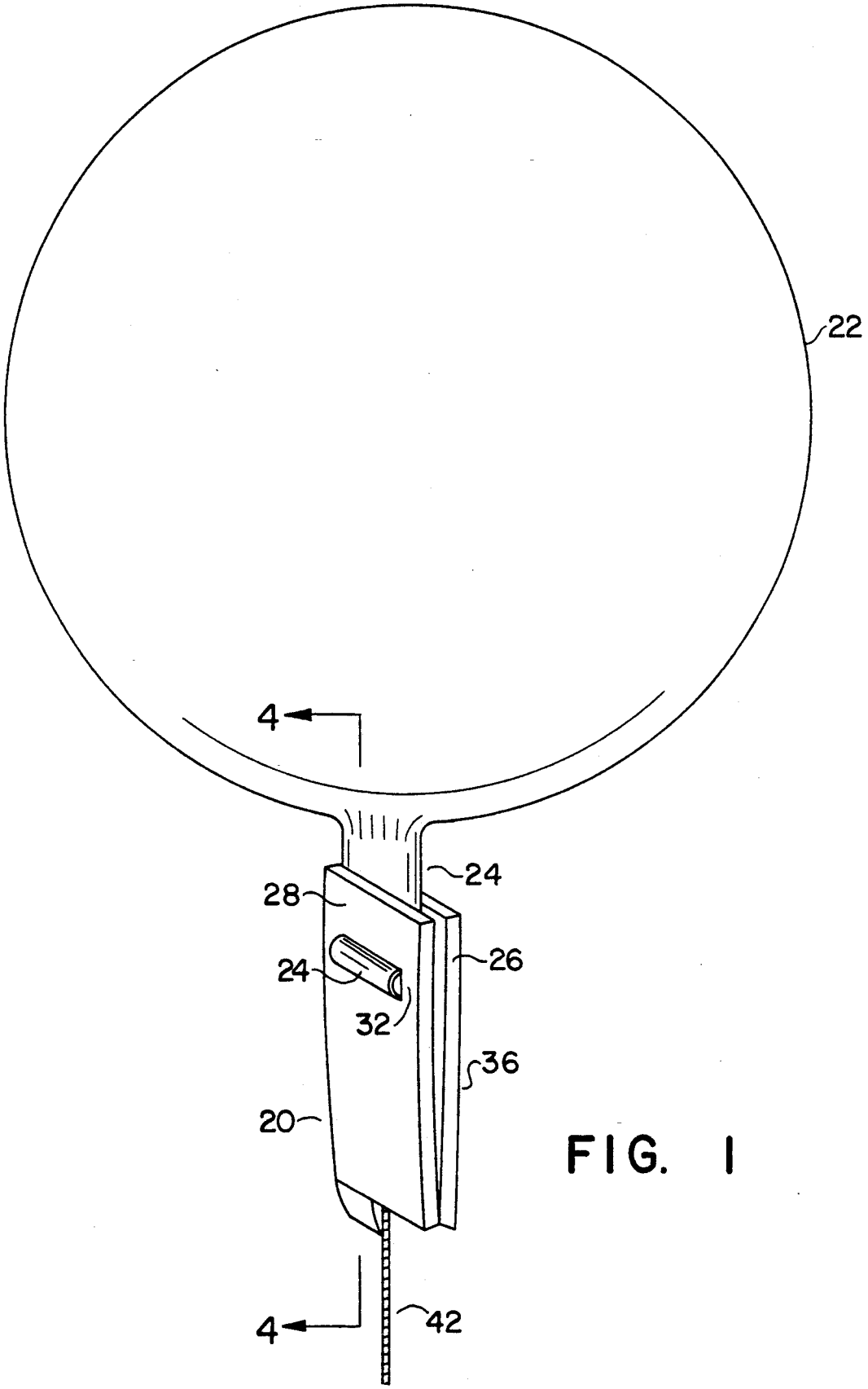
FIG. 1 is a perspective view of one embodiment of the present invention illustrating a string attached to the balloon.
Figure 2:
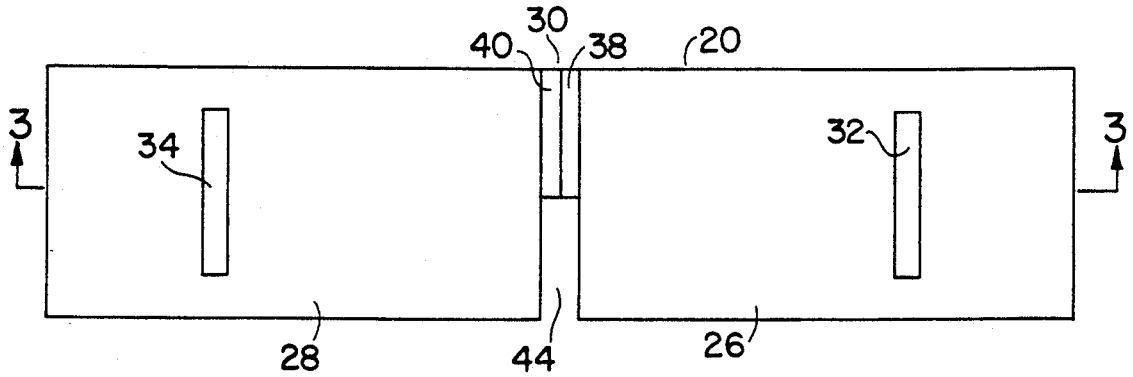
FIG. 2 is a bottom open view of the multi-purpose balloon closure of the present invention shown in the completely opened position.

Referring to the figures, shown in the FIGS. 1–4 is an embodiment of the present invention. The balloon closure device 20 comprises wings 26 and 28, a hinge portion 30 which interconnects the wings 26 and 28 along one edge, a closure member 32 which extends outwardly from one surface of the wing 26 and an opening 34 in wing 28 which is located directly opposite the closure member 32 and is substantially equal in width to the closure member 32 and slightly narrower than the thickness of the closure member 32. The wings 26 and 28 can be made thinner or tapered adjacent to the hinge 30 at the locations 38 and 40 for the purpose to be described hereinbelow and an opening 44 may be provided adjacent to, in the middle of or coaxial to the hinge 30.

In addition to the above, the balloon closure member 20 of the present invention is generally made from a semi-rigid material such as a plastic and the hinge portion 30 could be made using conventional methods or in substantially the same manner as a living hinge of the prior art. Still further, the closure member 32 could be provided with a hooked or bent end (not shown) so that it may more positively lock into the opening 34.

In operation, the stem 24 of the balloon 22 is placed between the wings 26 and 28 of the closure member 20 after the balloon 22 is inflated with air or lighter than air gas. Since the wings 26 and 28 are wider than the stem 24 of the balloon 22, the stem 24 is clamped between the wings 26 and 28. As the wings 26 and 28 approach each other, at least a portion of the stem 24 of the balloon 22 is forced through the opening 34 by the closure member 32. When the wings 26 and 28 are in the completely closed position and the closure member 32 penetrates through the opening 34 and is in an interlock relationship with the wing 28, closure member 32 and wing 28 cooperate to define a winding path for the stem 24 to prevent the passage of gas and in addition, those portions of the wings 26 and 28 which extend on either side of the closure member 32 and the opening 34 further compress and clamp the stem 24 to prevent leakage of gas from the inflated balloon 24.

Figure 8:
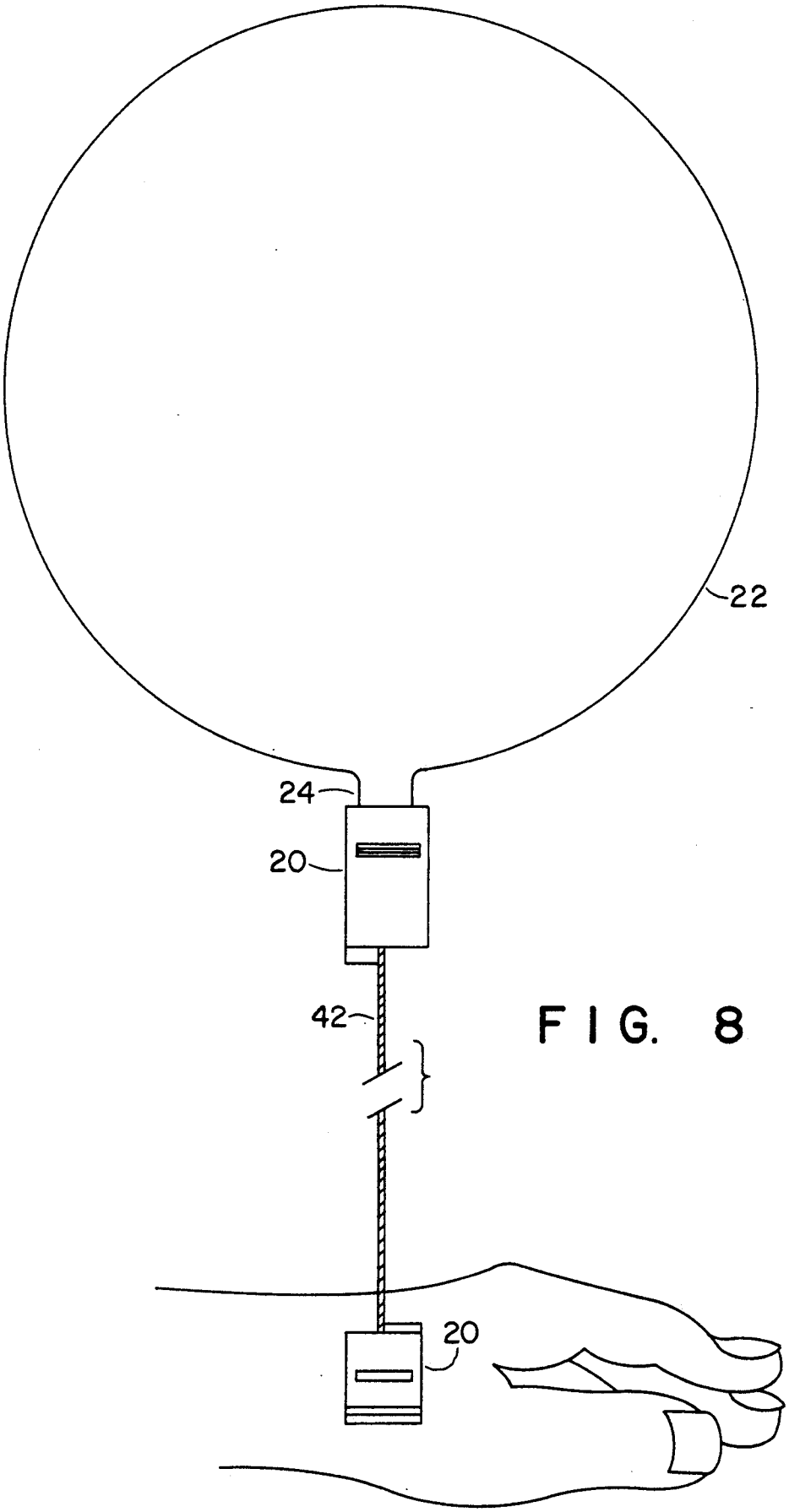
FIG. 8 is a view of a closure device of the present invention to be utilized to connect the hand of a human being to a balloon via a string.

Still further and as is apparent from FIGS. 1 and 8, a string 42 may be placed adjacent the hinge 30 before the balloon closure device 20 is closed. If tapered portions 38 and 40 of the wings 26 and 28 are provided, the string 42 will be compressed by the tapered portions 38 and 40 to hold the string 42. In addition, by the provision of the opening 44, the string can be centered in the middle of the closure device 20.

Figure 3:
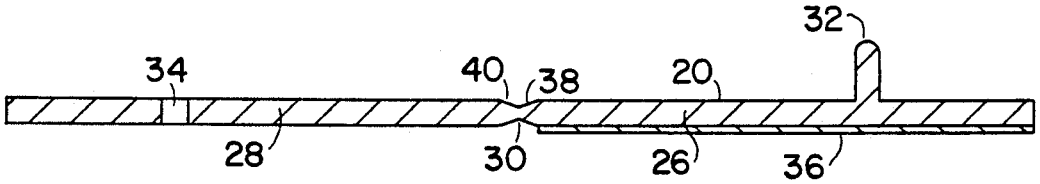
FIG. 3 is a cross-sectional view of FIG. 2 taken along the line 3—3.
Figure 4:
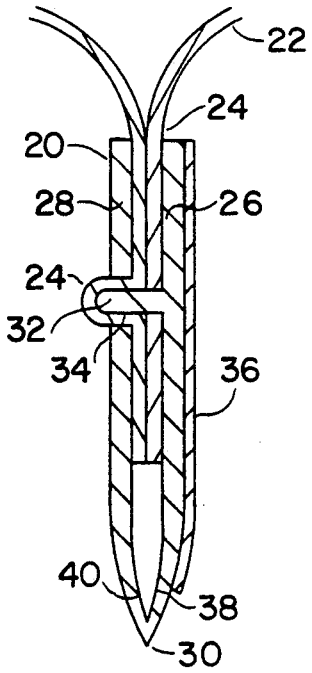
FIG. 4 is a partial cross-sectional view of the balloon closure device of Applicant's invention along the line 4—4 in FIG. 1.
Figure 5:
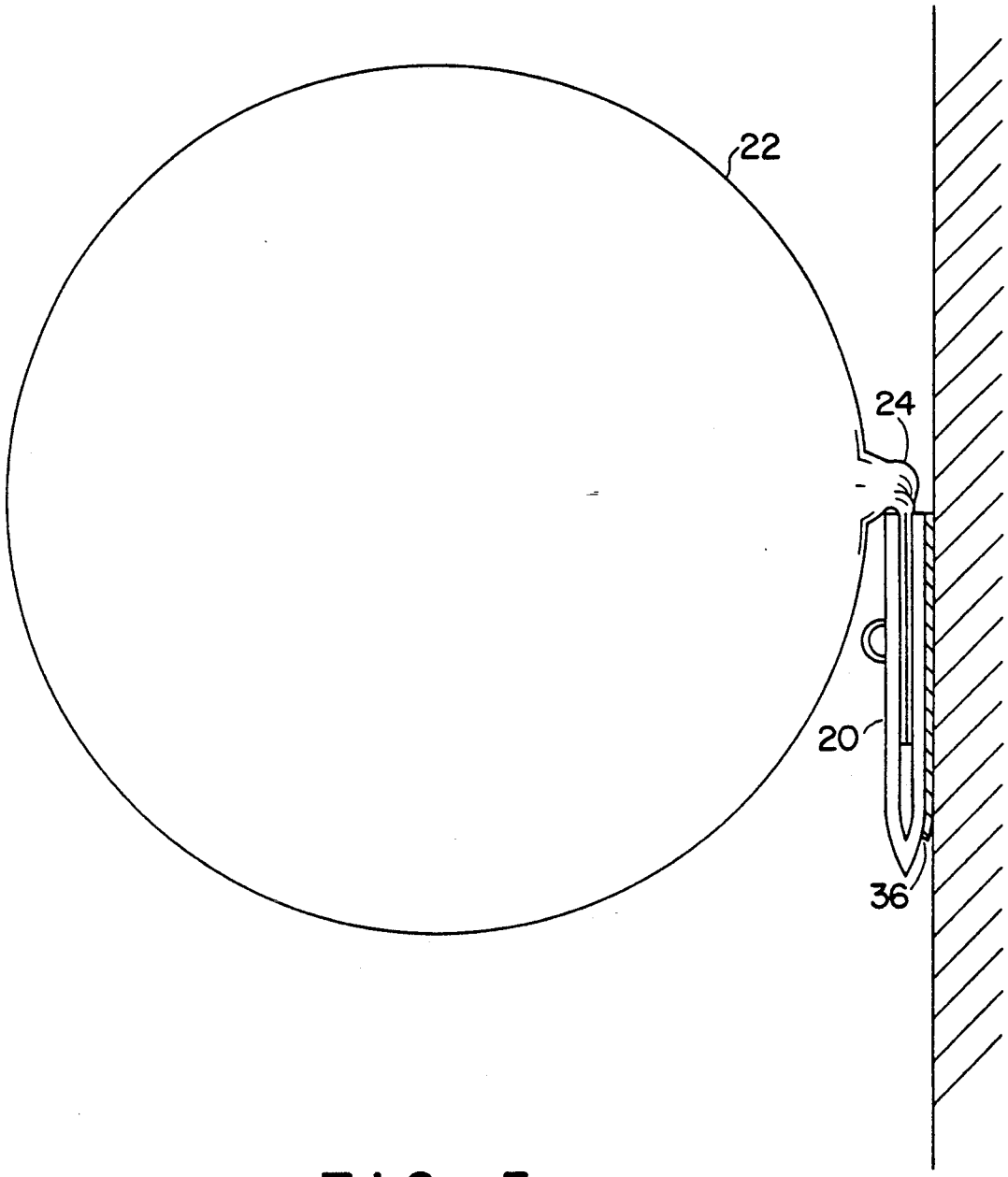
FIG. 5 is a view illustrating the present invention attached to a surface.

Still further, an adhesive layer 36 which may be either in the form of double sided tape or an adhesive applied to the wing 26 in a conventional manner may be provided as is shown in FIG. 3 and the adhesive may be utilized to attach the balloon to a surface as is shown in FIG. 5 or to the hand. Additionally, a closure device 20 can also be provided on the other end of the string 42 so that the string 42 can be easily attached to a child's hand by the adhesive layer 36 as is shown in FIG. 8.

Figure 6:
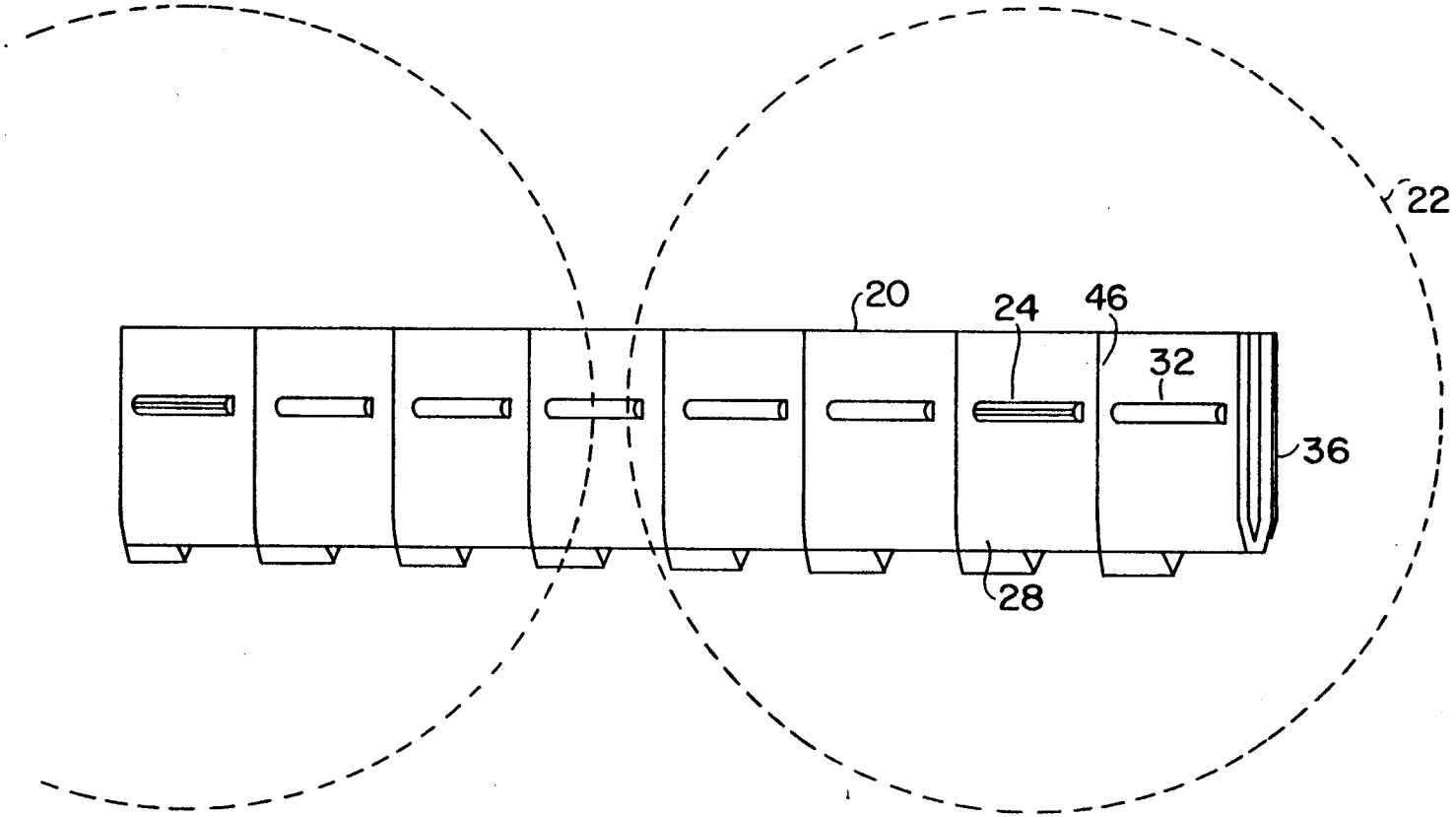
FIG. 6 is a view illustrating a plurality of the closure devices of the present invention attached together for use to make decorative arrangements.
Figure 7:
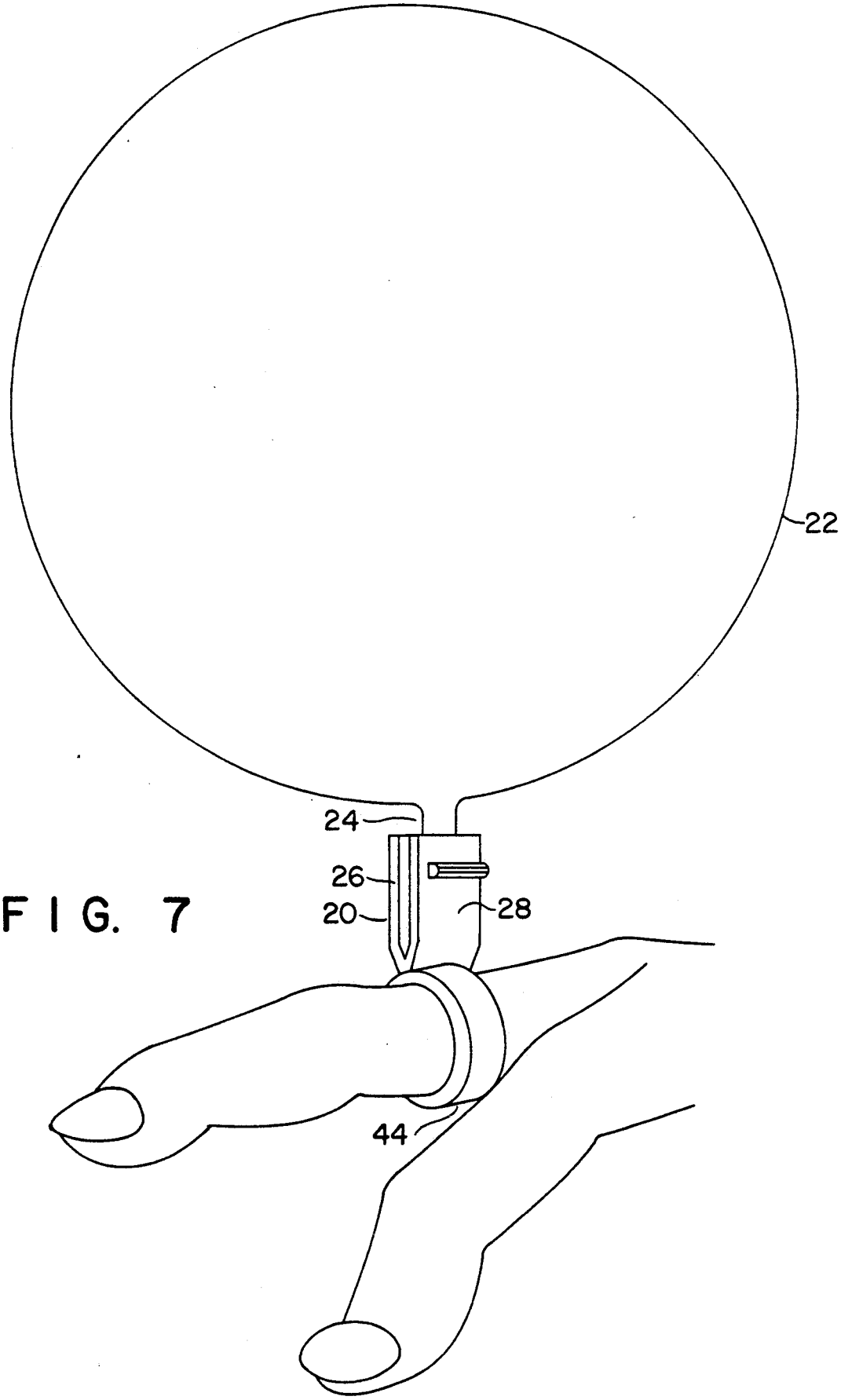
FIG. 7 is a plan view illustrating how the closure device of the present invention can be utilized to attach to the finger of a human.

Still further and as is shown in FIG. 6, the closure devices 20 may be formed as plural members in a long strip. The plural member of the devices 20 can be detachably connected together for easy separation, i.e. by providing perforations 46 between each of the plural devices 20. By the utilization of such a long strip, balloons may be attached to the strip at various locations and the strip of closure devices 20 may be shaped into decorative shapes because of the general rigidity of the material of the closure device 20. Since the closure devices 20 have their own rigidity, it is not necessary for three dimensional balloon decorations to utilize balloons filled with lighter than air gas and balloons filled with ordinary air can be utilized and still be used to create decorative arrangements.

Still further, the closure devices 20 may be further modified by molding a ring 44 onto the closure device 20 or making the ring 44 detachable by being provided with a tab which is engageable with the tapered portions 38 and 40 in the same manner as the string 42 and the ring 44 can be utilized to attach the closure device together with the inflated balloon 22 to the finger of a human being.

In addition to the description of the general construction of the balloon closure device 20 of the present invention, Applicant would like to further point out that the closure device 20 can be integrally molded utilizing injection molding techniques. In particular, the wings 26 and 28, hinge 30, opening 34 and closure member 32 together with the tapered portions 38 and 40 can be formed as an integral body by means of conventional methods such as injection molding. Still further, the particular plastic material utilized for the closure device 20 can be any suitable plastic material which has some rigidity, but still is resiliently flexible.

It should be apparent to those skilled in the art that the above-described invention represents only one construction of Applicant's invention and numerous and other constructions could be made without departing from spirit and scope of Applicant's invention.

I claim:

1. A multi-purpose closure device for the stem of an inflated balloon comprising:

a first wing of a generally elongated shape and having two ends;

a second wing having a generally elongated shape and two ends;

a hinge member interconnecting the first and second wings along one end;

a closure member provided on and projecting from one of said first or second wings;

an opening provided through the other of said first and second wings which corresponds to said closure member and is engageable with said closure member; and a cutout formed in said hinge member, said cutout extending transversely to said wings and being opened at one end;

whereby a stem of a balloon is both compressed along the entire length of the first and second wings and clamped by said closure member and said opening when said closure device is closed to provide a reliable but easily removable seal.

2. A balloon closure device according to claim 1 further comprising an adhesive means provided on the outside surface of at least one of said first or second wings.

3. A balloon closure device according to claim 1 further comprising tapered portions provided along an entire width of each of said first and second wings adjacent said hinge, said tapered portions being internal and opposing each other when said closure device is closed.

4. A balloon closure device according to claim 1 wherein said balloon closure devices are provided in plural number, and detachably connected together in a flexible strip whereby decorative and divergent balloon arrangements may be easily provided thereby.

5. A balloon closure device according to claim 1 further comprising a ring member formed integrally with said device adjacent said hinge member.

6. A balloon closure device according to claim 1 wherein the closure device is integrally molded from a resilient plastic.

7. A multi-purpose closure device for the stem of an inflated balloon comprising:

a first wing of a rectangular shape and having two ends, said first wing having an internal engaging surface and an exterior surface;

a second wing of generally rectangular shape and having two ends, said second wing having an internal engaging surface and an external surface;

a living hinge interconnecting the first and second wings along one end;

a substantially rectangular in cross section closure member provided integrally on and projecting from one of said first and second wings, said closure member extending transversely and having a width less than a width of said first and second wings;

an opening provided through the other of said first and second wings which corresponds to said closure member and is engageable with said closure member, said opening having a length less than a width of said first and second wings; and a cutout formed in the living hinge, said cutout extending transversely to said wings and being opened at one end;

whereby a stem of a balloon is both compressed along the length of the engaging surfaces of the first and second wings and clamped by the closure member and opening when said closure device is closed to provide a reliable but easily removable seal.

* * * * *